US005775797A

United States Patent [19]

Henstra

[11] Patent Number: 5,775,797

[45] Date of Patent: Jul. 7, 1998

[54] LINE ILLUMINATION DEVICE

[75] Inventor: Greald Henstra, Winterswijk, Netherlands

[73] Assignee: U.S. Philips Corporation, New York, N.Y.

[21] Appl. No.: 762,643

[22] Filed: Dec. 9, 1996

[30] Foreign Application Priority Data

Dec. 8, 1995 [EP] European Pat. Off. ..... 95203408

[51] Int. Cl.[6] ..... F21S 3/00

[52] U.S. Cl. ..... 362/225; 362/151; 362/219; 362/222

[58] Field of Search ..... 362/217, 225, 362/219, 222, 151

[56] References Cited

FOREIGN PATENT DOCUMENTS 609496 11/1960 Canada ..... 362/217

*Primary Examiner*—Carroll B. Dority
*Attorney, Agent, or Firm*—Walter M. Egbert

[57] ABSTRACT

The line-illumination device has a carrier (1), a plurality of tubular lamps (2) and a screen (5). Mounting brackets (7), which may be mounted to the screen (5) in any area of its length, are coupled to the screen (5) and to suspension brackets (6), which are coupled to the carrier (1) in a free area thereof. The suspension brackets (6) have a first hole (60) which extends up to the circumference of the bracket, and which may have a narrowed portion adjacent said circumference. A first pin (73) of the mounting brackets (6) is supported in said hole (60) and may be unround so as to be able to pass through the narrowed portion of the hole (60) in a rotational position which is different from rotational positions in which the pin (73) is supported in the hole (60). The construction of the device allows for an easy and fast assembling.

12 Claims, 5 Drawing Sheets

LINE ILLUMINATION DEVICE

BACKGROUND OF THE INVENTION

The invention relates to a line illumination device comprising:

a carrier;

a plurality of tubular lamps arranged in a line and each having end portions with respective lamp caps;

lampholder pairs which are connected to the carrier and in which respective tubular lamps are accommodated with their lamp caps;

a screen having a longitudinal direction parallel to the tubular lamps and having a side facing the carrier, which screen is suspended from suspension brackets fastened to the carrier, while the tubular lamps are present at said side of the screen facing the carrier.

Such a line illumination device is known from U.S. Pat. Nos. 5,357,412 and 5,422,800.

The known line illumination device has tubular fluorescent lamps alternating with single-ended compact fluorescent lamps whose lamp caps face towards the carrier and which extend between the tubular lamps. The device as a result is suitable for obtaining a light line of homogeneous brightness which supplies an even illuminance. Irregularities which may be caused by the presence of the lamp caps of the tubular fluorescent lamps and by comparatively dark end portions of the lamp are avoided in this line illumination device owing to the presence of the comparatively bright compact fluorescent lamps. Said lamps radiate light which compensates for the lack of light of the dark regions of the lampholder and the lamp cap and of the low-brightness regions at the ends of the lamp vessels of the tubular lamps on either side of these compact lamps. It is important here that a compact fluorescent lamp has a cap at one end only. The line illumination device may alternatively comprise tubular lamps of a different type, for example tubular neon lamps.

The discharge path in a compact fluorescent lamp is bent and/or kinked, i.e. the shortest imaginary connecting line between the electrodes of the lamp is bent and/or kinked within the lamp vessel. There is only one lamp cap, for example an Edison lamp cap or a lamp cap with contact pins, and the lamp has its greatest dimension in the extended direction of the lamp cap and transverse thereto smaller dimensions. The lamp as a result can be accommodated with its end portion remote from the lamp cap between two adjacent tubular lamps of the device. Often lamps have two or more, for example four tubular portions which are connected in series and lie next to one another. The lamps are commercially available in various power ratings, for example PL lamps with two tubular portions, PLC lamps with four tubular portions, possibly with integrated electronic supply circuits.

The known line illumination device may be used, for example, for creating a luminous line along interior or exterior walls, roof edges, etc. To give the device a length not equal to the length resulting when n tubular lamps and n−1 compact lamps are combined, a desired number of compact lamps in succession may be added.

It was found to be difficult to mount the screen quickly and to apply fastening means for the suspension brackets both to available locations of the carrier and to locations of the screen accurately corresponding thereto, especially during mounting of the line illumination device at a comparatively great height.

SUMMARY OF THE INVENTION

It is an object of the invention to provide a line illumination device of the kind described in the opening paragraph which is of a simple construction which renders possible a fast mounting of the screen.

According to the invention, this object is achieved in that mounting brackets capable of being fastened to any screen locations as desired in longitudinal screen direction are fastened to the screen, each mounting bracket is coupled to a respective suspension bracket, the suspension brackets each have a first hole extending into its circumference, and each mounting bracket has a first pin which is supported in said first hole.

Each mounting bracket may have, for example, a first hook, while a first strip is present at the screen, extending in longitudinal direction thereof. The hook then grips behind said strip. The result is that the mounting bracket may be applied in any location in the longitudinal direction of the screen, and that the actual location of the mounting bracket is determined by that location of the carrier where there is space for mounting the suspension bracket. The strip extending in longitudinal direction of the screen renders it possible in addition to manufacture the screen through extrusion of, for example, aluminum or synthetic resin.

It is favorable when the mounting brackets each have a second hook which is similarly directed as the first, and the screen has a second strip behind which the second hook grips. The stability of the screen suspension is enhanced thereby.

In an advantageous embodiment, at least one of the hooks has a snap connection with the associated strip. The coupling between the screen and the mounting brackets is self-locking then.

Mounting of the screen is even simpler when the mounting brackets are first coupled to the suspension brackets before they are coupled to the screen. Available fastening locations for the suspension brackets are then sought on the carrier, said brackets are placed, the mounting brackets are coupled thereto, and the screen is subsequently applied. The interspacings of the suspension brackets here define the interspacings of the mounting brackets coupled thereto, the latter being coupled to the screen in locations chosen at will.

It is favorable that the suspension brackets each have a first hole extending into their circumference, and the mounting brackets each have a first pin which is supported in said first hole. The mounting brackets may then be coupled to the suspension brackets very quickly.

In a favorable modification, the first hole has a throat adjacent the circumference of the suspension bracket and the first pin is unround, so that the first pin can only pass the throat in a rotational position which is different from rotational positions in which the pin is supported in the first hole. This has the advantage that the mounting bracket can still be easily coupled to the suspension bracket, but it cannot be uncoupled inadvertently. The pin may be brought into the hole through the throat with the mounting bracket being held, for example, horizontally if the rotational position in which the pin can be supported in the hole is a substantially vertical position. The mounting bracket is then coupled, for example freely suspended, and cannot be uncoupled inadvertently by an upward impact.

It is favorable for a rigid or more accurately defined suspension of the screen when the suspension brackets each have a second hole which extends into the circumference of the brackets, and the mounting brackets each have a second pin which is supported in the second hole. The second hole may be so shaped that the second pin enters it automatically and is supported therein when the mounting bracket is pressed towards the suspension bracket.

It is advantageous when means are present for locking the coupling between the mounting brackets and the suspension brackets. This is important in the case of use in the open air, where wind could move the screen out of position.

In an advantageous embodiment, the mounting brackets each have a cavity in which a locking member is present which blocks a displacement of the first pin of the mounting bracket in the first hole of the suspension bracket. The locking member may have, for example, a hairpin-type shape and may first be closed when the pin is introduced into the cavity and may subsequently, for example, snap resiliently outwards.

It is favorable when the suspension brackets each have a projection which cooperates with the screen and which prevents an uncoupling of the screen and the mounting brackets. A stronger locking of the screen is obtained thereby than that obtained already by a clamped or snapped connection between the mounting brackets and the screen and by the coupling between the mounting brackets and the suspension brackets.

In a favorable embodiment of the line illumination device, the carrier has mutually facing U-shaped portions, and the suspension brackets each have a transversely flanged rim which is fixed into the U-shaped portions by a bayonet movement. The coupling between the suspension brackets and the carrier can be realized quickly then.

In a special embodiment, the suspension brackets each have an elongate hole which extends in longitudinal direction of the bracket and is circumferentially bounded in order to facilitate a deformation of the bracket laterally of the hole. Such a deformation leads to a shortening of the bracket at one side of the hole, whereby a free end of the bracket is moved up or down, and portions of the screen situated next to one another can be mutually aligned, if so desired. The deformation may be achieved, for example, by means of pliers of which one jaw is furcate and the other jaw is arranged between the teeth of the first. A fold may now be made on either side of the hole in the bracket in that the pliers are closed farther or less far around the bracket laterally of the hole, thus shortening the bracket at the relevant side.

In another special embodiment, the suspension brackets each have recesses at their circumference between the carrier and the screen, which recesses face away from one another and are each formed along a fluent line. These recesses provide the bracket with a local narrowing and weakening which render possible a deformation in the plane of the brackets.

BRIEF DESCRIPTION OF THE DRAWINGS

Embodiments of the line illumination device according to the invention are shown in the drawing, in which

In FIG. 1, the line illumination device comprises a carrier 1, a plurality of tubular lamps 2, fluorescent lamps in the Figure, arranged in a line and each having end portions 20 with respective lamp caps 21, and lamp holder pairs 3*a, b* connected to the carrier 1, a tubular lamp 2 being accommodated with its lamp caps 21 in each lampholder pair. The device in the embodiment drawn also has a single-ended compact fluorescent lamp 4 between every two tubular lamps 2, with its lamp cap 40 facing towards the carrier 1, as well as a screen 5 with a longitudinal direction parallel to the tubular lamps 2 and with a side 50 facing the carrier 1. The screen 5 is suspended from suspension brackets 6 which are fastened to the carrier 1, while the tubular lamps 2 as well as the compact fluorescent lamps 4 are arranged at said side 50 of the screen which faces the carrier 1 The electric wiring and gear for the tubular lamps 2 and the compact lamps 4, lamps with four straight, parallel discharge tube portions arranged in series in the Figure, are accommodated in the carrier 1. The carrier, made of aluminum, is closed with an aluminum plate 8. The carrier may be fastened against or in a recess of a wall, interior or exterior, or, for example, a roof edge. The tubular lamps 2 may be surrounded by tubes of, for example, polyacrylate which are closed in a watertight manner for use in the open air, while the compact lamps 4 may each be accommodated in a bell jar so as to realize the desired operating temperature for the lamps also in cold whether.

Figure 1:
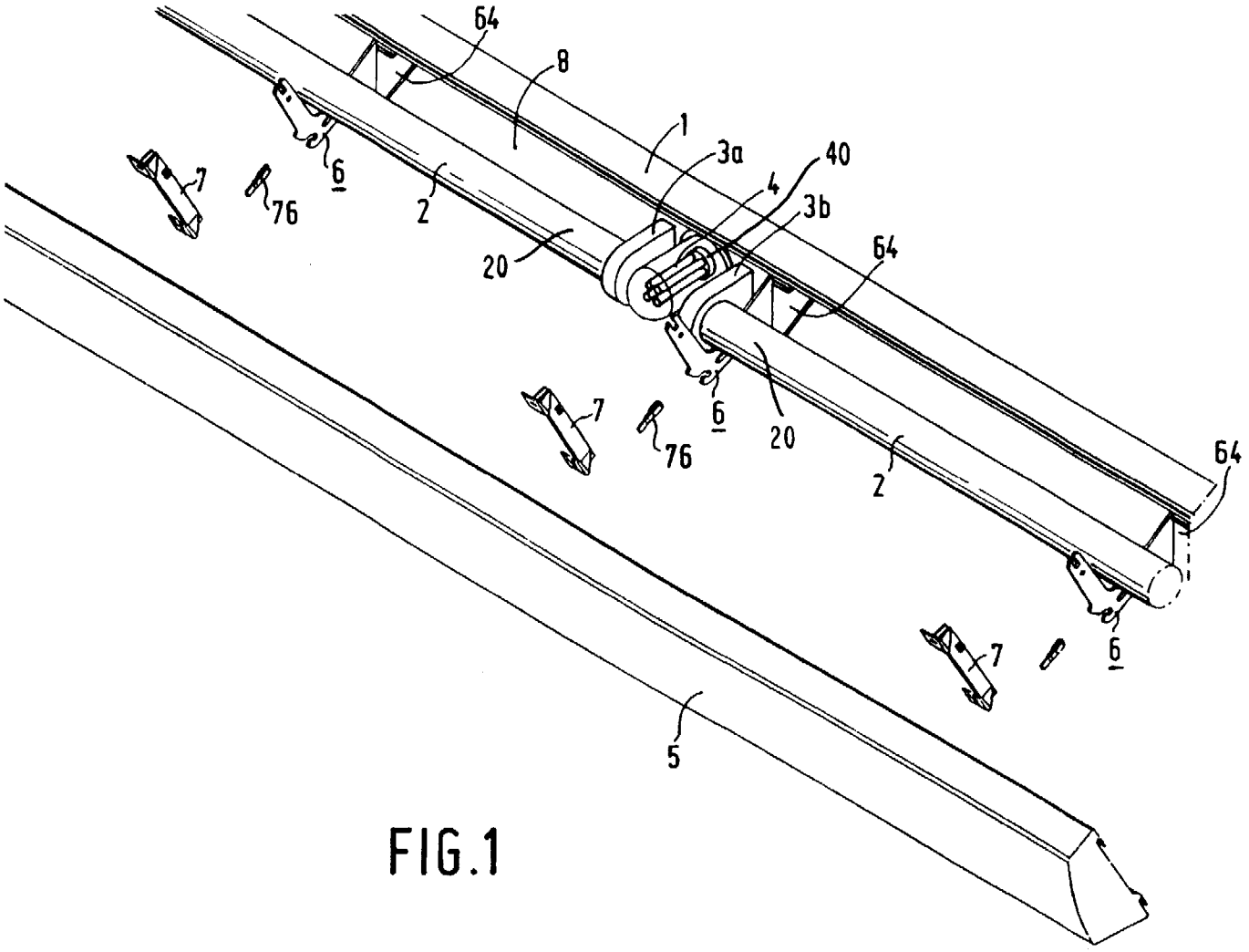
FIG. 1 shows an embodiment in exploded view.

Mounting brackets 7, each coupled to a respective suspension bracket 6, are fastened to the screen 5, said mounting brackets being capable of fastening in any spot as required in longitudinal screen direction. The suspension brackets 6 each have a first hole 60 extending into the circumference thereof, and the mounting brackets 7 each have a first pin 73 which is supported in said first hole 60. The mounting brackets 7 in the embodiment shown have a sandwich structure of two strips with the pin 73 in between.

A first hook 70, see FIGS. 2 to 6, is present at each mounting bracket 7, and a first strip 51 extending in longitudinal direction of the screen 5 is present at this screen. The hook 70 grips behind the strip 51. The screen is made of synthetic resin, for example of polymethyl methacrylate in the embodiment shown, and possibly colored, for example having a color at its side 50 facing the carrier which is different from the rest. The mounting brackets are made of transparent synthetic resin, for example of polycarbonate.

Figure 2:
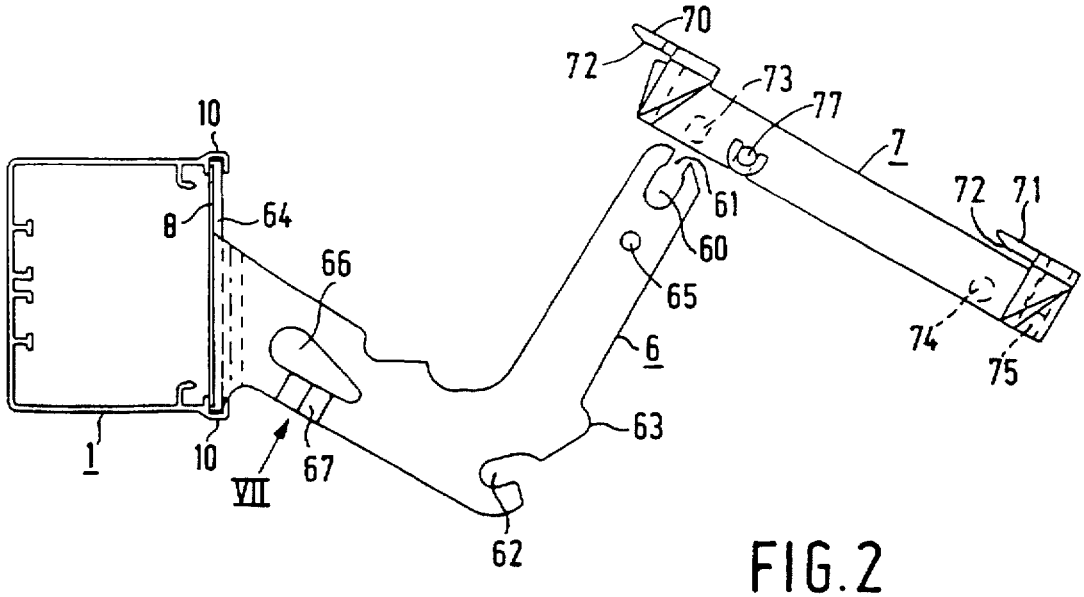
FIGS. 2 to 6 show the device of FIG. 1 without lamps, viewed laterally, during consecutive manufacturing steps.
Figure 3:
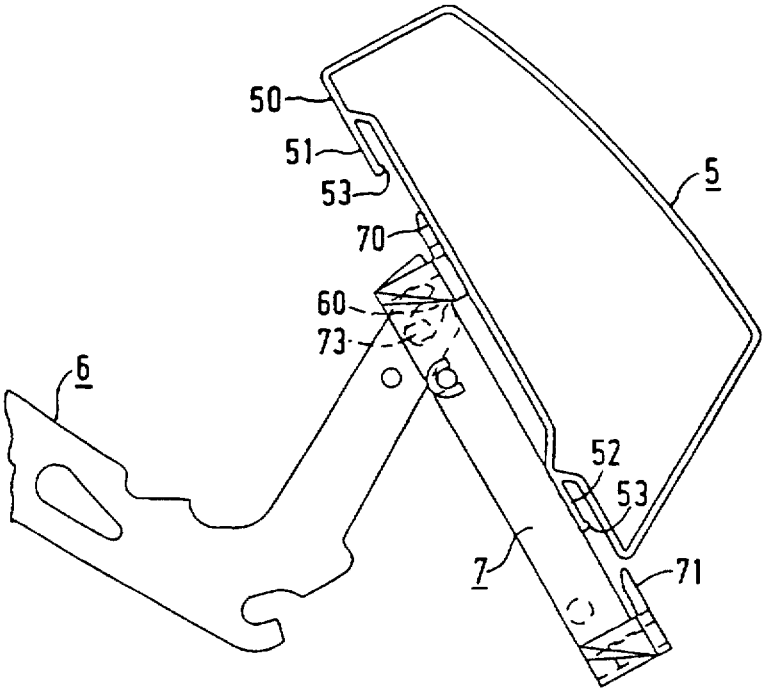
Figure 4:
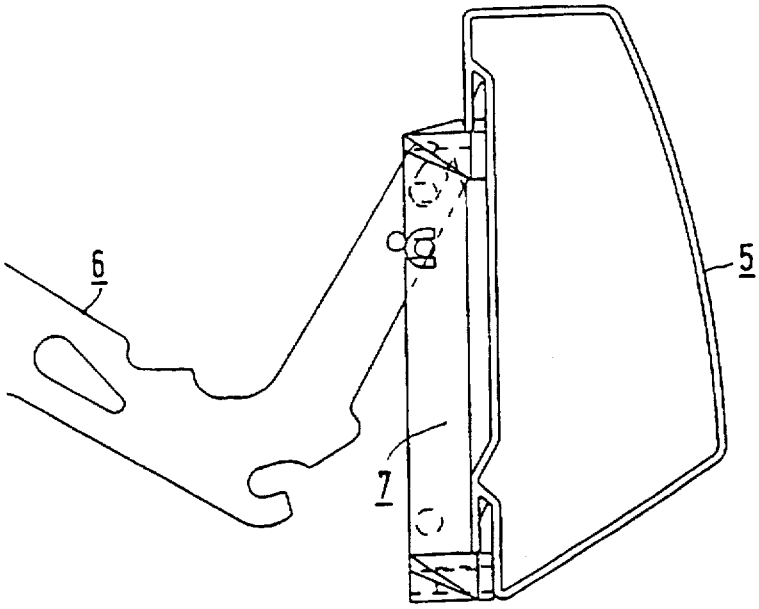
Figure 5:
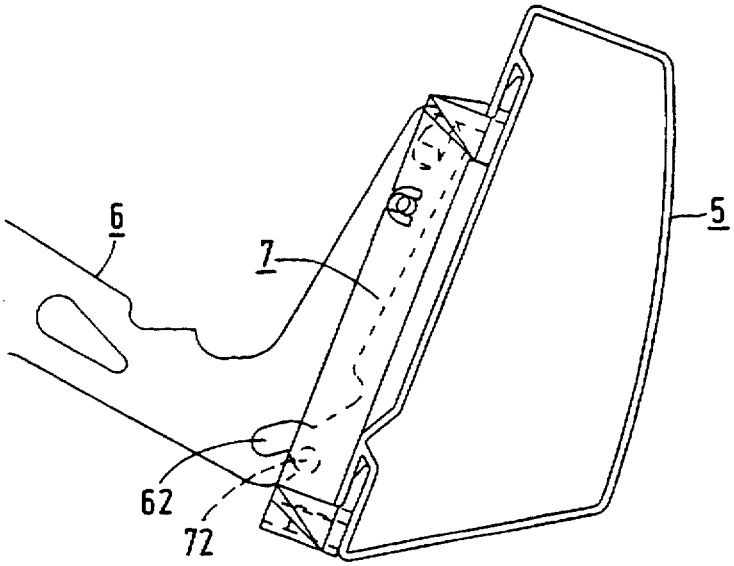

The mounting brackets 7, see FIGS. 2 and 3, each have a second hook 71 which is similarly directed as the first 70, and the screen has a second strip 52. The second hook 71 grips behind the second strip 52, see FIG. 2.

Both hooks 70, 71 have a snap connection 72, 53 with the respective strips 51, 52, so that the screen is locked.

The first hole 60, see FIG. 2, has a throat 61 adjacent the circumference of the suspension bracket 6, and the first pin 73 is unround and is capable of passing the throat 61 only in a rotational position which is different from rotational positions in which the pin is supported in the first hole 60. [niet: 61]

Figure 6:
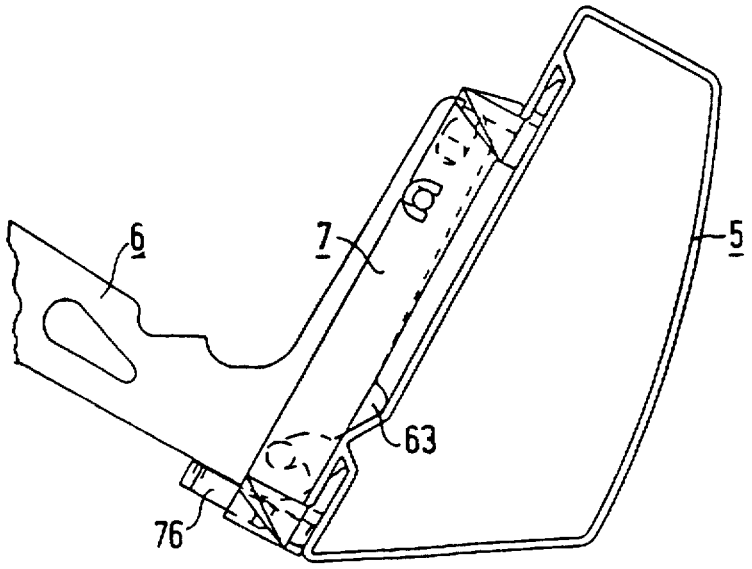

The suspension brackets 6 also each have a second hole 62 which extends into the bracket circumference, and the mounting brackets 7 each have a second pin 74 which is supported in the second hole 62, see FIG. 6. The second pin in the embodiment shown is self-locating.

Means are present, see FIG. 6, for locking the coupling between the mounting brackets 7 and the suspension brackets 6. The mounting brackets 7 each have a cavity 75 in which a locking member 76 is present which blocks a displacement of the first pin 73 of the mounting bracket 7 in the first hole 60 of the suspension bracket 6, thus also inhibiting a displacement of the second pin 74 in the second hole 62.

The suspension brackets 6 each have a projection 63 which cooperates with the screen 5 and prevents an uncoupling of the screen 5 and the mounting brackets 7.

The carrier 1 has mutually facing U-shaped portions 10, and the suspension brackets 6 each have a transversely flanged rim 64, see also FIG. 1, which is fixed in the U-shaped portions 10 in a counterclockwise bayonet movement. The suspension bracket 6 present on the left of the rim 64 thus keeps the rim 64 in its operational position by the bracket's own weight.

In FIG. 2, a mounting bracket 7 rotated into a position perpendicular to the suspension bracket 6 is being coupled to this suspension bracket. In FIG. 3, the screen 5 is brought against the mounting bracket 7, whereby said bracket automatically assumes the same rotational position as the screen. The coupling between said parts is achieved with a click in that the screen is pressed down, see FIG. 4. A pressure exerted on the lower side of the screen 5 causes the second pin 74 to enter the second hole 62 in a self-locating manner, during which the screen is lifted a little. The first pin 73, however, cannot leave the first hole 60 in the position shown in FIG. 5, neither can it in the position shown in FIG. 6. In FIG. 6, both pins 73, 74 have reached their lowest positions in the respective holes 60, 62. The locking member 76 prevents the mounting bracket 7 from moving back, i.e. up. The mounting bracket 7 has thus been fixed in position on the suspension bracket 6. The projection 63 at the suspension bracket 6 prevents the screen 5 from moving upward and thus provides an additional locking for the screen 5.

The line illumination device according to the invention can be easily installed by one mechanic also in the case of comparatively long screens and also in comparatively high places. Apart from a possible adapter piece, the screen may thus have a standard length which differs from the length of a tubular lamp or of a tubular lamp plus compact lamp, or a multiple thereof.

Mutually corresponding holes 65, 77 are present in the suspension brackets 6 and the mounting brackets 7, which holes may be used for alternative locking means such as resilient pins, split pins, bolt and nut, etc.

Figure 7:
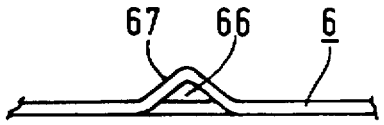
FIG. 7 shows a detail of FIG. 2 viewed along VII.

FIG. 7 shows the fold 67 laterally of the elongate hole 66 in the suspension bracket 6, whereby the bracket 6 has been shortened below the hole 66, see FIG. 2, and the free end with the hole 60 has been displaced in downward direction so as to align the screen 5 in that location with adjoining portions thereof.

Figure 8:
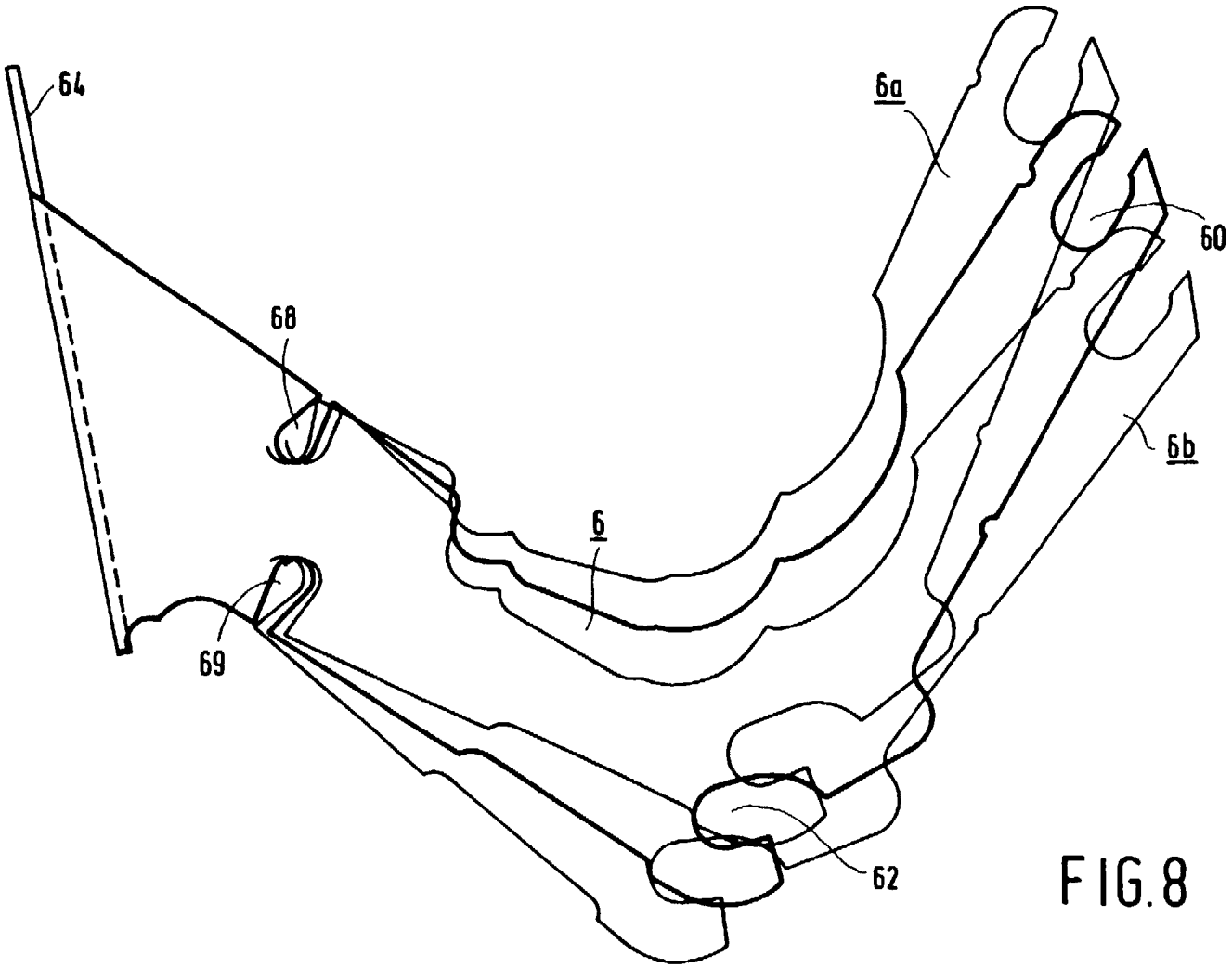
FIG. 8 shows a modification of the suspension bracket of FIG. 2.

In FIG. 8, the suspension bracket 6 has a shape largely corresponding to that of FIG. 2, with a flanged rim 64 for coupling the bracket 6 to a carrier 1 (cf. FIG. 2) and with a first hole 60 and a second hole 62 for coupling the bracket 6 to a mounting bracket 7 of a screen 5 (cf. FIG. 3).

Between the carrier 1 and the screen 5, the suspension bracket 6 has recesses 68, 69 at its circumference which face away from one another and are each formed along a fluent line. They have a hairpin shape in the Figure.

The bracket 6 can be deformed in order to be aligned with adjoining brackets. The recess 68 has become narrower and the recess 69 wider if this deformation has led to the shape of bracket 6*a*. The bracket 6 may alternatively be bent in opposite direction in order to obtain, for example, the shape of bracket 6*b*.

I claim:

1. A line illumination device comprising:

a carrier (1);

a plurality of tubular lamps (2) arranged in a line and each having end portions (20) with respective lamp caps (21);

lampholder pairs (3*a*, *b*) which are connected to the carrier (1) and in which respective tubular lamps (2) are accommodated with their lamp caps (21);

a screen (5) having a longitudinal direction parallel to the tubular lamps (2) and having a side (50) facing the carrier (1), which screen (5) is suspended from suspension brackets (6) fastened to the carrier (1), while the tubular lamps (2) are present at said side (50) of the screen (5) facing the carrier (1), characterized in that mounting brackets (7) capable of being fastened to any screen locations as desired in longitudinal screen direction are fastened to the screen (5), each mounting bracket (7) is coupled to a respective suspension bracket (6), the suspension brackets (6) each have a first hole (60) extending into its circumference, and each mounting bracket (7) has a first pin (73) which is supported in said first hole (60).

2. A line illumination device as claimed in claim 1, characterized in that the first hole (60) has a throat (61) adjacent the circumference of the suspension bracket (6) and the first pin (73) is unround, such that the first pin (73) can only pass the throat (61) in a rotational position which is different from rotational positions in which said pin is supported in the first hole (60).

3. A line illumination device as claimed in claim 1, characterized in that the suspension brackets (6) each have a second hole (62) which extends into the circumference of the bracket, and the mounting brackets (7) each have a second pin (74) which is supported in the second hole (62).

4. A line illumination device as claimed in claim 1, characterized in that means are present for locking the coupling between the mounting brackets (7) and the suspension brackets (6).

5. A line illumination device as claimed in claim 4, characterized in that the mounting brackets (7) each have a cavity (75) in which a locking member (76) is present which blocks a displacement of the first pin (73) of the mounting bracket (7) in the first hole (60) of the suspension bracket (6).

6. A line illumination device as claimed in claim 4, characterized in that the suspension brackets (6) each have a projection (63) which cooperates with the screen (5) and which prevents an uncoupling of the screen (5) and the mounting brackets (7).

7. A line illumination device as claimed in claim 6, characterized in that the carrier (1) has mutually facing U-shaped portions (10), and the suspension brackets (6) each have a transversely flanged rim (64) which is fixed into the U-shaped portions (10) by a bayonet movement.

8. A line illumination device as claimed in claim 6, characterized in that the suspension brackets (6) each have an elongate hole (66) which extends in longitudinal direction of the bracket and is circumferentially bounded in order to facilitate a deformation of the bracket (6) laterally of the hole (66).

9. A line illumination device as claimed in claim 4, characterized in that a first hook (70) is present at each mounting bracket (7) and a first strip (51) is present at the screen (5), extending in longitudinal direction thereof, and the hook (70) grips behind the strip (51).

10. A line illumination device as claimed in claim 9, characterized in that the mounting brackets (7) each have a second hook (71) which is similarly directed as the first (70), and the screen (5) has a second strip (52) behind which the second hook (71) grips.

11. A line illumination device as claimed in claim 10, characterized in that at least one of the hooks (70, 71) has a snap connection with the associated strip (51, 52).

12. A line illumination device as claimed in claim 6, characterized in that the suspension brackets (6) each have recesses (68, 69) at their circumference between the carrier (1) and the screen (5), which recesses face away from one another and are each formed along a fluent line.

* * * * *